US007023398B2

(12) United States Patent
Gottl et al.

(10) Patent No.: US 7,023,398 B2
(45) **Date of Patent: *Apr. 4, 2006**

(54) REFLECTOR FOR A MOBILE RADIO ANTENNA

(75) Inventors: Maximilian Gottl, Frasdorf (DE); Stefan Berger, Rohrdorf (DE)

(73) Assignee: Kathrein-Werke KG, Rosenheim (DE)

( * ) Notice: Subject to any disclaimer, the term of this patent is extended or adjusted under 35 U.S.C. 154(b) by 111 days.

This patent is subject to a terminal disclaimer.

(21) Appl. No.: 10/455,796

(22) Filed: Jun. 6, 2003

(65) Prior Publication Data

US 2004/0201542 A1 Oct. 14, 2004

(30) Foreign Application Priority Data

Apr. 11, 2003 (DE) ..... 103 16 787

(51) Int. Cl.
*H01Q 1/42* (2006.01)

(52) U.S. Cl. ..... 343/872; 343/817; 343/795

(58) Field of Classification Search ..... 343/795, 343/797, 815, 817, 818, 872
See application file for complete search history.

(56) References Cited

U.S. PATENT DOCUMENTS

| | | | | |
|---|---|---|---|---|
| 4,458,251 | A | 7/1984 | Bondon | 343/914 |
| 4,893,132 | A | 1/1990 | Habibi | 343/912 |
| 5,710,569 | A | 1/1998 | Oh et al. | 343/817 |
| 5,952,983 | A * | 9/1999 | Dearnley et al. | 343/817 |
| 5,999,145 | A | 12/1999 | Niekamp | 343/890 |
| 6,067,053 | A * | 5/2000 | Runyon et al. | 343/797 |
| 6,072,439 | A * | 6/2000 | Ippolito et al. | 343/797 |
| 6,166,705 | A | 12/2000 | Mast et al. | 343/853 |
| 6,313,809 | B1 | 11/2001 | Gabriel et al. | 343/797 |
| 6,333,720 | B1 | 12/2001 | Gottl | 343/810 |
| 6,339,407 | B1 | 1/2002 | Gabriel et al. | 343/797 |
| 6,646,611 | B1 * | 11/2003 | Plet et al. | 343/702 |
| 6,717,555 | B1 * | 4/2004 | Teillet et al. | 343/797 |
| 6,850,130 | B1 | 2/2005 | Gottl et al. | 333/161 |

FOREIGN PATENT DOCUMENTS

| | | |
|---|---|---|
| CA | 2 261 625 | 4/2003 |
| DE | 1 516 823 | 4/1966 |
| DE | 36 14 191 C2 | 1/1987 |
| DE | 37 80 794 T2 | 2/1993 |
| DE | 42 07 009 A1 | 9/1993 |
| DE | 198 29 714 A1 | 1/1999 |
| DE | 198 23 749 A1 | 12/1999 |
| DE | 600 00 260 T2 | 3/2003 |
| EP | 0 352 160 A | 1/1990 |
| EP | 0 892 461 A | 1/1999 |
| EP | 0 892 461 A1 | 1/1999 |
| EP | 0 916 169 B1 | 5/1999 |

(Continued)

*Primary Examiner*—Shih-Chao Chen
(74) *Attorney, Agent, or Firm*—Nixon & Vanderhye P.C.

(57) ABSTRACT

A reflector for a mobile radio antenna comprises at least two reflector modules which are or can be assembled. The reflector module is produced using a casting method, deep-drawing, thermoforming or stamping method, or using a milling method. Two integrally connected longitudinal face boundaries and at least one end transverse-face boundary may be provided. Two transverse-face boundaries whose ends are located offset with respect to one another can be provided. At least one transverse strut runs transversely with respect to the longitudinal face boundaries. A holding and/or attachment device is provided on the at least one end transverse-face boundary for attachment to a second reflector module, and can be used to fix the at least two reflector parts firmly to one another.

19 Claims, 8 Drawing Sheets

FOREIGN PATENT DOCUMENTS

| | | |
|---|---|---|
| EP | 0 520 908 B1 | 3/2000 |
| EP | 1 133 223 B1 | 7/2002 |
| GB | 2 150 355 A | 6/1985 |
| GB | 2 296 385 A | 6/1996 |
| WO | WO 99/62138 | 12/1999 |
| WO | WO 00/39894 | 7/2000 |
| WO | WO 01/13459 | 2/2001 |
| WO | WO 03/017425 A1 | 2/2003 |

* cited by examiner

REFLECTOR FOR A MOBILE RADIO ANTENNA

FIELD

The technology herein relates to a reflector, in particular for a mobile radio antenna.

BACKGROUND AND SUMMARY

Mobile radio antennas for mobile radio base stations are normally constructed such that two or more antenna element arrangements, which are located one above the other, are provided in the vertical direction in front of a reflector plane. These antenna element arrangements are formed, for example, from dipoles or patch antenna elements. These may be antenna element arrangements which can transmit and/or transmit and receive at the same time. They can operate only in one polarization or, for example, in two mutually perpendicular polarizations. The entire antenna arrangement may be designed for transmission in one band or in two or more frequency bands by using, for example, two or more antenna elements and antenna element groups which are suitable for the various frequency bands.

Depending on the requirements, mobile radio antennas are generally used which have different length variants. The length variants often depend, inter alia, on the number of individual antenna elements or antenna element groups to be provided. Identical or similar antenna element arrangements are generally arranged repeatedly one above the other in such arrangements.

An antenna or an antenna array such as this may have a common reflector for all the antenna element arrangements. This common reflector is normally formed by a reflector plate which may be stamped, curved and/or bent depending on the requirements. For example, such reflector configuration makes it possible to form a reflector edge area, which projects forwards from the reflector plane, on the two opposite side vertical edges. Furthermore, if required, additional sheet-metal parts may be soldered on the reflector. The use of profiles is also known, for example extruded profiles made of aluminum etc., which are likewise fitted on or in front of the reflector plane.

Costly, complex, three-dimensional functional surfaces for the antenna element arrangements are advantageous, or even necessary, for certain applications. Until now, a large number of connecting points and contact points have generally been required on the reflector in order to produce such surrounding conditions for the antenna element arrangement. Some of the parts and components which are used are also still in some cases made of different materials. However, this can result in a number of disadvantages. For example, the large number of different parts and the major assembly effort associated with them can be disadvantageous. Overall, these can result in comparatively high production costs. Another possible disadvantage is the large number of contact points. A large number of contact points can contribute to undesirable intermodulation products. Adequate functional reliability can often be achieved by taking the greatest possible care during assembly. On the other hand, the antennas that are produced in this way generally have a restricted function and load capability since, particularly in the case of unsuitable material combinations or even if there are only a small number of bad contact points, it may not be possible to comply with the requirements relating to undesirable intermodulation products. If a test run of the checked polar diagram of an antenna reveals problems, then it is also not necessarily immediately possible to state which contact points may have contributed to the deterioration in the intermodulation characteristics.

The illustrative non-limiting exemplary technology described herein provides an improved capability to produce antennas with high quality characteristics, by means of which it is furthermore intended to be possible to produce antennas of different physical sizes with comparatively little complexity and to a high quality standard.

The illustrative non-limiting exemplary technology described herein proposes a solution for constructing different length variants of antennas with the same or a similar function with comparatively little complexity. The reflector devices may also be used for antennas of different construction which may, for example, hold different antenna elements or antenna element assemblies. Finally, even complex, three-dimensional surrounds with functional surfaces in the transverse and/or longitudinal direction or in other directions of the reflector can be produced using simple means. Functional surfaces such as these may also be produced, for example, aligned at an angle to the major axis, that is to say generally at an angle to the vertical axis in which the reflector extends.

At the same time, the exemplary illustrative non-limiting antenna or reflector configuration described herein makes it possible to considerably reduce the number of contact points. In turn, this makes it possible to reduce the large number of different parts and the assembly effort, with a high degree of functional integration as well.

The exemplary illustrative non-limiting implementations described herein provide for a reflector to be constructed from at least two separate reflector modules, which may be mounted jointly, for example in the vertical direction in an extension of their vertical axis. It is generally desirable to produce an overall arrangement which is mechanically robust from at least two or more reflector modules which can be fitted to one another in the vertical direction. It is also generally desirable to provide an overall arrangement furthermore with desired characteristic values from the electrical point of view for the antenna element arrangement which is provided on each reflector module.

Accordingly, in the exemplary illustrative non-limiting implementation, at least the basic version of each reflector module is formed integrally, specifically preferably using a casting, deep-drawing, thermoforming, stamping or milling method. The expression master gauge method can also be used in this connection in some cases. The reflector module may thus, for example, be formed from an aluminium cast part or generally from a metal casting or else from a plastic injection-molded part, which is then provided with a metalized surface on one surface, or at least on both opposite surfaces.

The exemplary illustrative non-limiting reflector module can also be produced using a tixo casting method or else, for example, by milling. In this case, the example reflector module implementation preferably has a circumferential rim, at least on its two longitudinal faces and on at least one narrower transverse face, but preferably on both of its longitudinal faces and on both of its end faces. Thus, lateral boundary webs or boundary surfaces may project transversely with respect to the reflector plane provided on the two opposite vertical faces. In addition, one or in each case one boundary web or a boundary surface may be provided on at least one of the end faces, and preferably on both opposite end faces.

Each reflector module may also have at least one fixed integrated central transverse web. Such a transverse web may comprise at least one upper and one lower field for antenna element arrangements which can be used there.

At least two antenna element surrounds may thus be defined for each reflector module. These antenna element surrounds may be produced by an end-face boundary wall, two sections of the vertical side longitudinal boundaries and the at least one web wall which runs transversely with respect to the side boundary walls.

A reflector module formed in this way may then also be suitable for being joined to at least one further reflector module, for example of the same physical type, at the end face to form an entire reflector arrangement with a greater vertical extent.

One exemplary illustrative non-limiting implementation provides for a final reflector to be formed from at least two reflector modules which are joined together with the same orientation. In an alternative exemplary illustrative non-limiting refinement, it is also possible to join the end faces of two reflector modules together, with the two reflector modules being aligned with their basic shapes at 180° to one another. This exemplary non-limiting assembly has been found to be particularly advantageous when the two opposite end face surfaces have different shapes, that is to say when only one end face surface is suitable for actually joining it to a next reflector module.

Reflector modules may also be joined together with different shapes but with a comparable basic structure, as described above.

As is known, the forces which act on a reflector and the operating loads which are produced by the actions of these forces, for example resulting from vibration, wind and storms, should not be underestimated. Loads such as these naturally occur particularly strongly at the junction point in an exemplary illustrative non-limiting reflector arrangement when using at least two modules whose end faces are joined together. However, moving and undefined contacts should generally also not be used in order to avoid undesirable intermodulation problems.

One exemplary illustrative non-limiting implementation therefore provides for the corresponding end walls to be appropriately matched for joining together at least two reflector modules. For this purpose, they preferably may have attachment points which are offset with respect to one another in two planes. This makes it possible firstly to transmit and to absorb comparatively large moments, while at the same time providing functionally reliable electrical contact points. An electrically conductive contact can be made between the two reflector modules in the area of their end walls that are joined together. Or, they can also be connected to one another without any electrically conductive connection, for example by inserting an insulating intermediate layer, for example a plastic layer or some other dielectric, between them. In some circumstances, a damper material can also preferably be used for the intermediate joint for an insulating layer such as this, which means that the two reflector module halves may even oscillate to a certain extent with respect to one another, to a restricted extent, in a severe storm. This thus serves to improve mechanical reliability.

The offset plane of the attachment points, that has been mentioned, also serves to ensure that shape discrepancies are not additive at the connecting interface. If necessary, such phenomenon can be compensated for with comparatively few problems, in such a way that production tolerances can be compensated for. If, for optimization of the polar diagram of an antenna, it is necessary or desirable to attach additional metallic elements at specific points in the reflector, then, in one exemplary illustrative development, these additional elements may be used, for example, in the form of electrically conductive strips, webs etc., by means of separate holding devices. For example, electrically nonconductive holding devices can be preferably formed from plastic or from some other dielectric. They can be fitted to the existing intermediate webs or side boundary wall sections. In one exemplary illustrative implementation, between the holding devices, the metallic elements which have to be inserted in addition can then be hooked in. This capacitive anchoring then once again furthermore avoids undesirable intermodulation products.

One exemplary illustrative non-limiting implementation provides for a reflector module which has been produced using a casting, deep-drawing, thermoforming or stamping method. Alternatively, a milling method can be used. Further integrated parts, or parts of further components, which are required in particular in conjunction with an antenna can be provided, on the rear face of the reflector module, opposite the antenna element modules for example. This allows functional integration to be achieved in the reflector, associated with further significant advantages.

In exemplary illustrative implementations, the following functional elements may, for example, be integrated in the reflector module without any problems:

It is thus possible also to integrally form outer conductor contours for carrying radio-frequency signals, for example a grooved cable, coaxial cable, stripline etc., on the front face or else in particular also on the rear face of the reflector.

In the same way, contours may be integrally formed for electromagnetic screening of assemblies.

Housing parts for RF components such as filters, diplexers, distributors and phase shifters may also be integrally formed, such that all that need be done after incorporation of the additional functional parts in these assemblies is to fit a cover as well.

Particularly if metalized plastic parts are used as the basis for the reflector, complete cable structures can also be integrated by suitable measures such as hot stamping, two-component injection molding methods, laser processing, etching methods or the like ("three-dimensional printed circuit board").

Interfaces for holding components for attachment or mounting as well as interfaces for accessories, for example in the form of attachment flanges, heat flanges etc., can also be provided.

BRIEF DESCRIPTION OF THE DRAWINGS

These and other features and advantages will be better and more completely understood by referring to the following detailed description of exemplary non-limiting illustrative implementations in conjunction with the drawings, of which.

DETAILED DESCRIPTION

Figure 1:
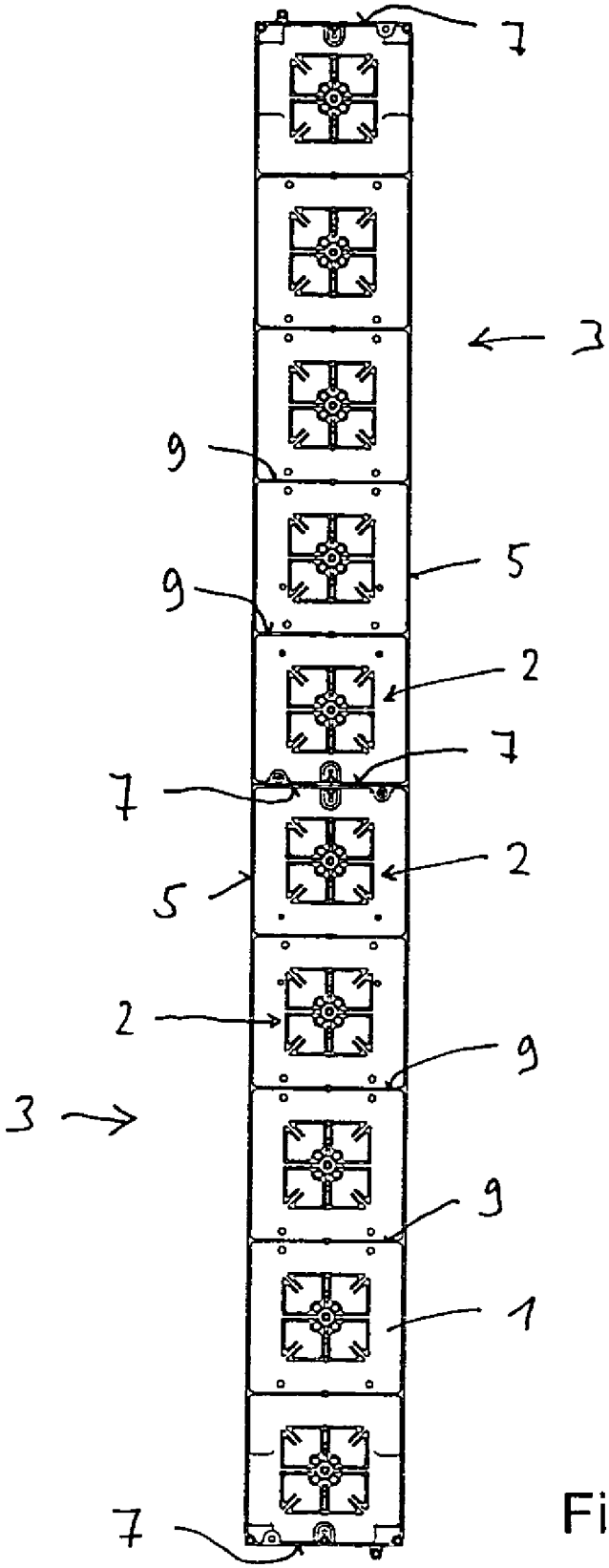
FIG. 1 shows a schematic plan view of an exemplary illustrative non-limiting reflector comprising two reflector modules which are arranged vertically one above the other.

FIG. 1 shows a schematic plan view of an exemplary illustrative non-limiting reflector 1 which, in the illustrated exemplary arrangement, is formed from two reflector modules 3 whose end faces are joined together and in each of which four antenna element arrangements 2 are arranged one above the other in the vertical direction. The illustrated antenna element modules are, from the electrical point of view, modules in the form of cruciform antenna elements which radiate (e.g., can transmit and receive) two mutually perpendicular polarizations. These are preferably antenna elements arranged in an X-shape, in which the polarization planes are aligned at angles of plus 45° to minus 45° with respect to the horizontal and vertical. This specifically illustrated and indicated type of antenna element is known for example, from the prior application WO 00/39894. To this extent, reference is made to this prior application, which is included in the content of the present application. However, any other desired antenna element arrangements, for example in the form of dipole squares, cruciform antenna elements, single-polarized dipole antenna elements or other antenna elements or antenna element devices, including patch antenna elements, may also be used.

Figure 2:
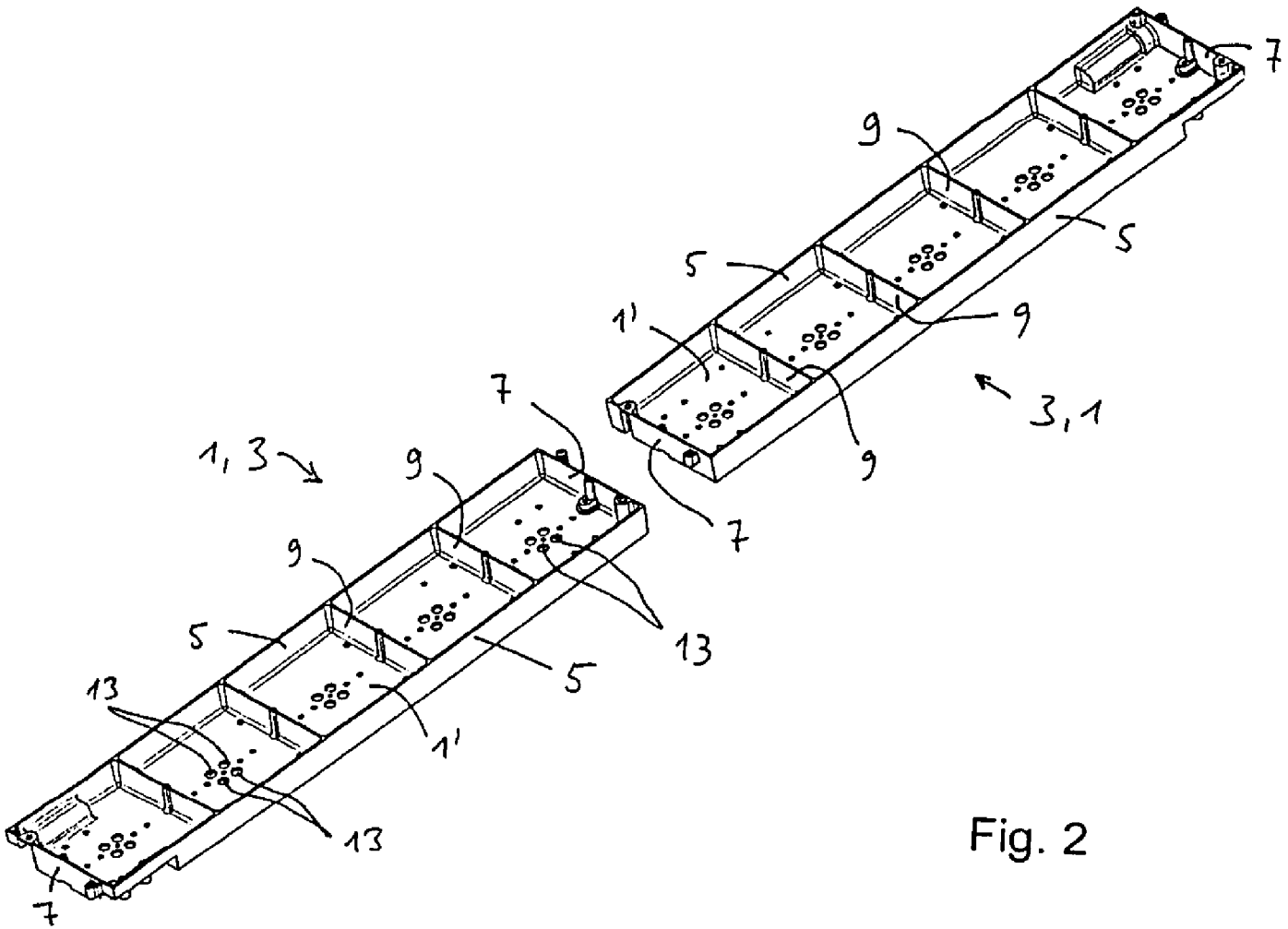
FIG. 2 shows a perspective illustration of two exemplary illustrative non-limiting reflector modules, which are arranged in the vertical direction with respect to one another, before being joined together.

As can also be seen in particular from the perspective illustration in FIG. 2, each reflector module has in each case two longitudinal face boundaries 5 and two end-face transverse face boundaries 7, which are formed in a manner of a reflector boundary wall or boundary web, boundary flange etc., and project transversely with respect to the plane of the reflector 1, preferably at right angles to the plane of the reflector plate. The height above the plane 1' of the reflector 1 may in this case be modified, and differ within wide ranges, depending on the desired characteristic polar diagram properties of an antenna constructed in this way.

The reflector modules 3 are, for example, made using a metal die-casting method, using an injection-molding method for example in the form of a plastic injection-molding method, in which the plastic is then coated on at least one face, preferably all the way round, at least with a conductive metalized surface. However, in principle, it would also be possible to use reflector parts which may have been produced using a deep-drawing or thermoforming method, a stamping method, using a so-called tixo casting method, or else, for example, by means of a milling method. In places, the following text also speaks of a master gauge method, although this term does not cover all the production methods mentioned above.

In the described exemplary illustrative non-limiting implementation, each of the reflector modules also has four transverse webs 9 which are arranged spaced apart from one another at the vertical interval of the illustrated reflector, and which are likewise also produced using a master gauge method as mentioned above. In the illustrated exemplary non-limiting arrangement, five antenna element surrounds are produced in this way for each reflector module 3 and are each formed by a section of the two outer side boundary walls and by two central or transverse webs 9, which are spaced apart from one another, or by a transverse web 9 and one of the two end-face boundary walls 7.

A series of holes are incorporated by means of apertures 13 in the plane 1' of the reflector 1 in each such antenna element surround 11, on which the desired single-polarized or, for example, dual-polarized antenna element modules can then be firmly anchored and fitted to the reflector 1. The antenna element modules themselves, in particular dipole antenna element structures or patch antenna element structures, may have widely different shapes. In this context, reference is made to already known antenna elements and antenna element types which are common knowledge to those skilled in the art. Merely by way of example, reference is in this context made to the antenna element structures which are known from the prior publications DE 198 23 749 A1 or WO 00/39894, which are all suitable for the present situation. In the same way, the reflector module may also be used for antennas and antenna arrays which transmit and receive not only in one frequency band but in two or more frequency bands by, for example, fitting antenna element arrangements which are suitable for different frequency bands in the individual antenna element surrounds. To this extent, reference is once again made to already known fundamental solutions. Thus, in other words, the antenna elements which can be formed in the antenna element surrounds comprise, for example, dipole antenna elements, that is to say single dipole antenna elements which operate in only one polarization or in two polarizations, for example comprising cruciform dipole antenna elements or dipole antenna elements in the form of a dipole square, so-called vector dipoles which transmit and receive cruciform beams, such as those which are known from WO 00/39894, or antenna element arrangements which can transmit and receive in one polarization or two mutually perpendicular polarizations, for example also using two or three frequency bands, or more, rather than just one. This also applies to the use of patch antenna elements. To this extent, the arrangement of the reflector modules is not restricted to specific antenna element types.

Figure 3A:
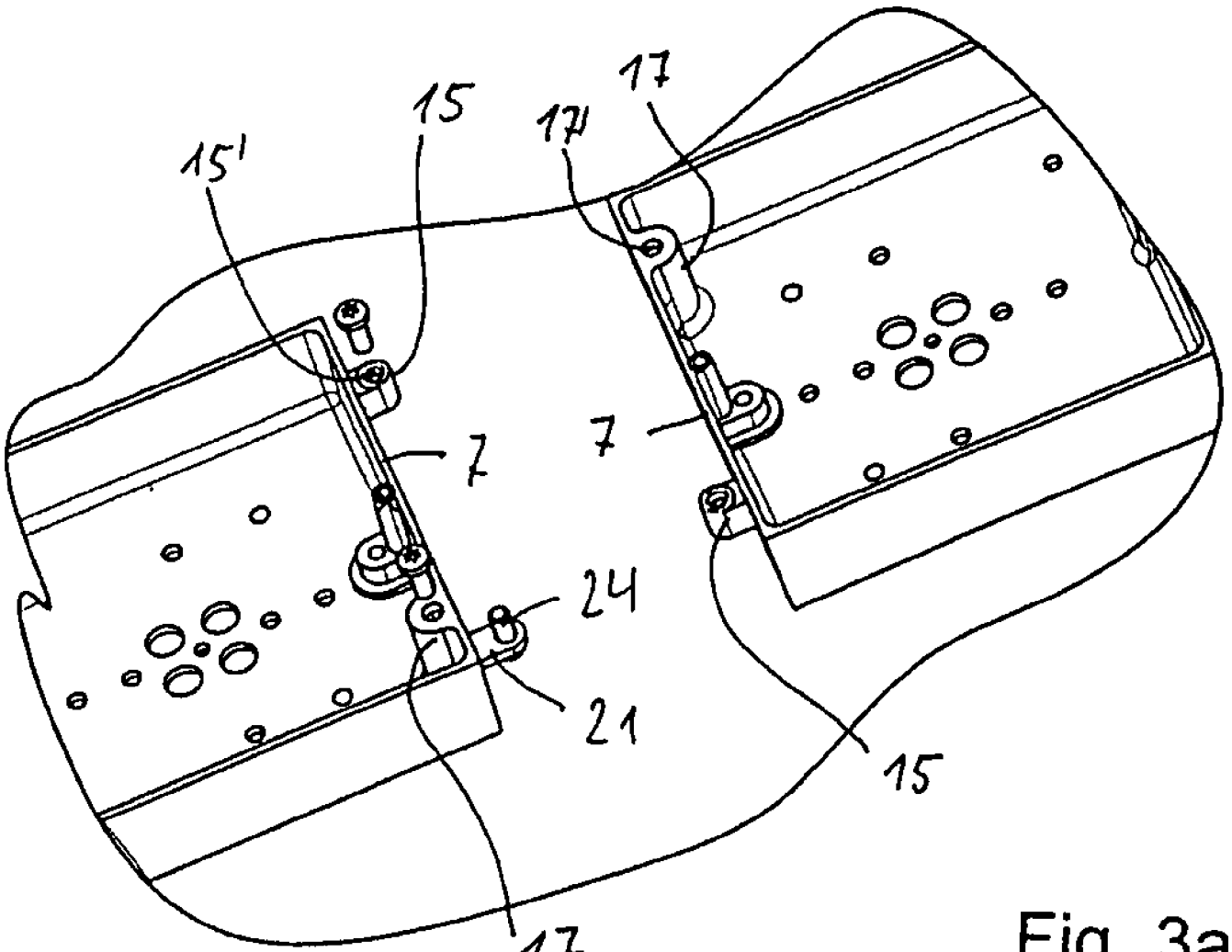
FIG. 3*a* shows an enlarged perspective detailed illustration to show how two exemplary illustrative non-limiting reflector modules may be configured and joined together at their end-face boundary sections which point towards one another.
Figure 3B:
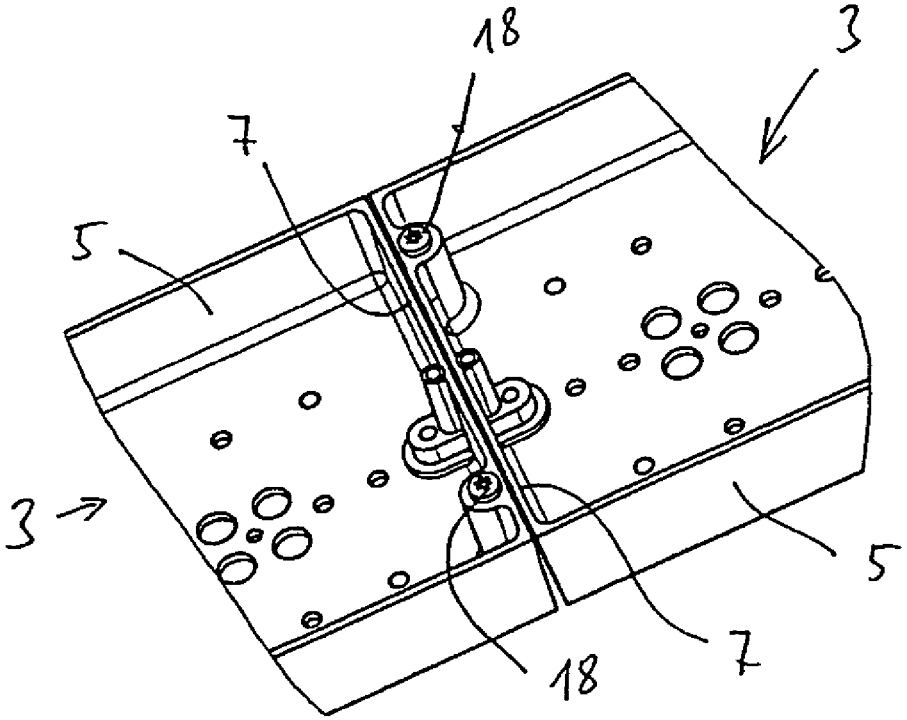
FIG. 3*b* shows an illustration corresponding to FIG. 3*a*, but after the two exemplary illustrative non-limiting reflector modules have been joined together by their end faces.
Figure 4:
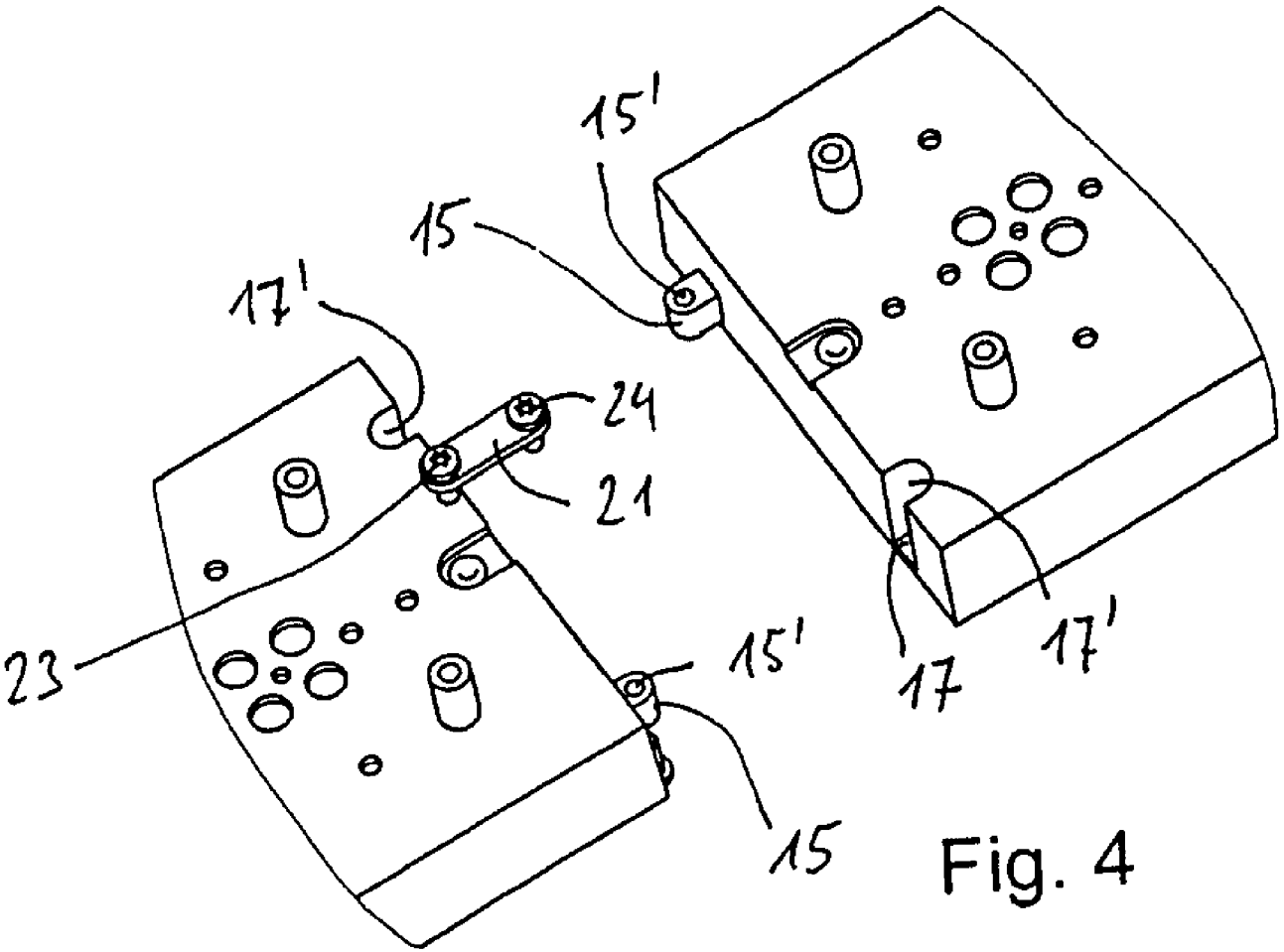
FIG. 4 shows an illustration corresponding to FIG. 3, but seen from the rear face.

In the described exemplary illustrative non-limiting implementation, the reflector 1 is assembled in two identical antenna element modules 3, to be precise with them being joined together at their end-face or transverse face boundaries 7 that are provided for this purpose. This is because threaded hole attachment 15, which projects in the fitting direction and whose axial axis is aligned transversely with respect to the plane of the reflector plate, is provided there, offset from the central longitudinal plane towards the outer edge, and preferably extending over part of the height transversely with respect to the reflector plane 1'. A threaded hole attachment 17 which projects inwards is then formed on the other side of the vertical central longitudinal plane, in such a way that, with antenna element modules 3 which are aligned offset through 180° with respect to one another, as illustrated in FIGS. 2 to 4, the end face side boundary surfaces 7 of these two antenna element modules 3 can now be moved towards one another so that the respective threaded hole attachment 15 which projects on each end face of the respective antenna element module 3 engages in a corresponding recess 17' on the other end face of the adjacent antenna element module 3, which is adjacent in the axial direction to the threaded hole attachment 17 which projects inwards. In this case, the threaded hole 15' which is incorporated in the attachment 15 which projects on each end face comes to rest, in a plane view, directly in an axial extension underneath the threaded hole 17' in the attachment 17, which projects inwards, on the respective second reflector module 3, so that a screw 18 can be screwed into the threaded holes 15', 17', which are each arranged in pairs one above the other. The corresponding attachments 15 and 17 are thus provided at different heights on each end wall 7 on each of the two reflector modules 3, so that they can be joined together in a relative position rotated through 180°, as shown in FIGS. 3*a* and 3*b*. The overall dimensions and shapes in this case are such that the two end-face transverse boundary walls 7 of the two reflector modules make a fixed contact with one another in this position, and only in this position.

Since, furthermore, the threaded hole attachments 15 and 17 are offset outwards from the vertical central longitudinal plane and are each formed at a different height on each reflector module 3 (with respect to the plane 1' of the reflector 1), this results in optimum two-point support, which can absorb high forces, including wind and vibration forces.

If necessary, before the two end-face boundary walls 7 of the two reflector modules are joined together, an intermediate material, which is used as a damper, can also be inserted like a sandwich between the two end faces 7, which rest against one another, of two adjacent reflector modules 3 which are fitted to one another. This also makes it possible to allow the two reflector modules to oscillate with respect to one another to a minor extent, which may have advantages, particularly when the antenna is subject to very strong forces in severe storms, and to vibration.

As can also be seen from FIGS. 3*a*, 3*b* and 4, it is also possible to use additional connecting lugs 21, which connect the two reflector modules 3, from each of which a screw 23 can be screwed in one reflector module 3, and the second screw 24 can be screwed in from the bottom face of the respective other reflector module 3. The one or more connecting lugs in this case overhang the separating surface which separates the two reflector modules 3.

Figure 5:
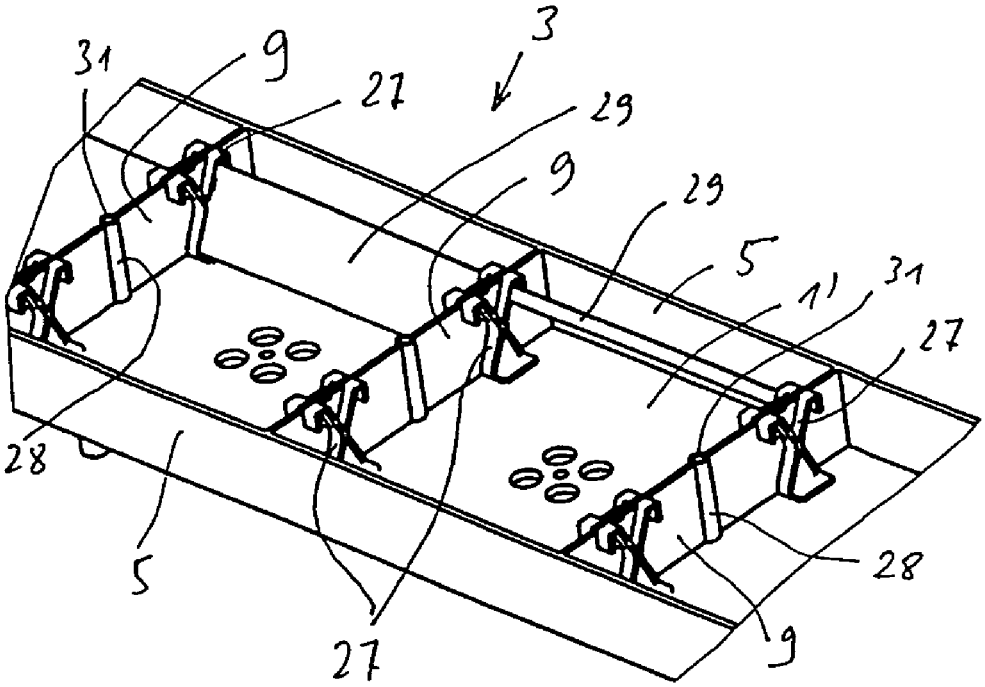
FIG. 5 shows a perspective illustration of a detail of an exemplary illustrative non-limiting reflector module with additional, preferably dielectric, holding and attachment elements for holding further beam forming parts in the form of strips, rods etc.

The following text refers to FIG. 5, which shows a detail of two radiation surrounds 11 of a reflector module.

In this case, nonconductive holding or attachment devices 27 are fitted to each of the existing transverse webs 9, which are formed in the course of the master gauge process, and these holding or attachment devices 27 are provided with recesses in the form of slots, in order in this case to make it possible, for example, to use a further electrically conductive functional parts which are used for beam forming and/or for decoupling and which, to be precise, can be used capacitively. This is because the holding and attachment devices 27 are electrically nonconductive, and are preferably made of plastic or from some other suitable dielectric. The capacitive attachment of the said functional parts 29 likewise further suppresses undesirable intermodulation products. Furthermore, the supplementary attachment and incorporation which may be required in the radiation surrounds 11 by means of the said holding and attachment device 27 is comparatively simple and is feasible in a very highly variable manner.

Furthermore—as can also be seen from the drawings, for example FIG. 5—further anchoring sections 28, which are provided with holes 31 that are aligned transversely with respect to the plane 1' of the reflector, are provided on the transverse struts 9 that are provided in the factory, to which anchoring sections 28 it is possible to fit, for example, additional components which are used for beam forming and/or for decoupling, for example functional parts in the form of pins or rods etc. which extend at right angles to the plane 1' of the reflector. The holes 31 thus extend at right angles to the plane 1' of the reflector, with the holding and attachment devices 28 being in the form of reinforcing sections in the transverse struts 9 or else, if required and as shown in the illustration in FIGS. 3*a* and 3*b* on the transverse face boundaries 7.

Figure 6:
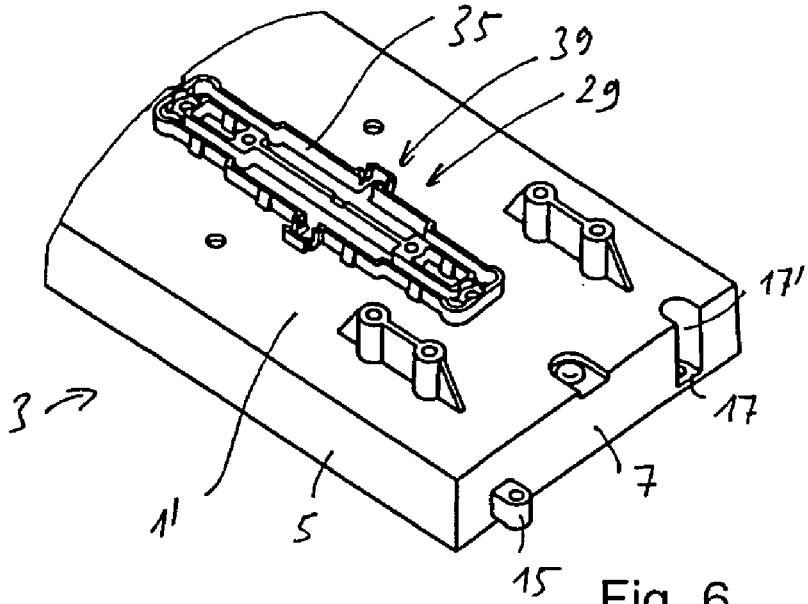
FIG. 6 shows a perspective rearward view of an exemplary illustrative non-limiting reflector module with integrally formed functional points.
Figure 7:
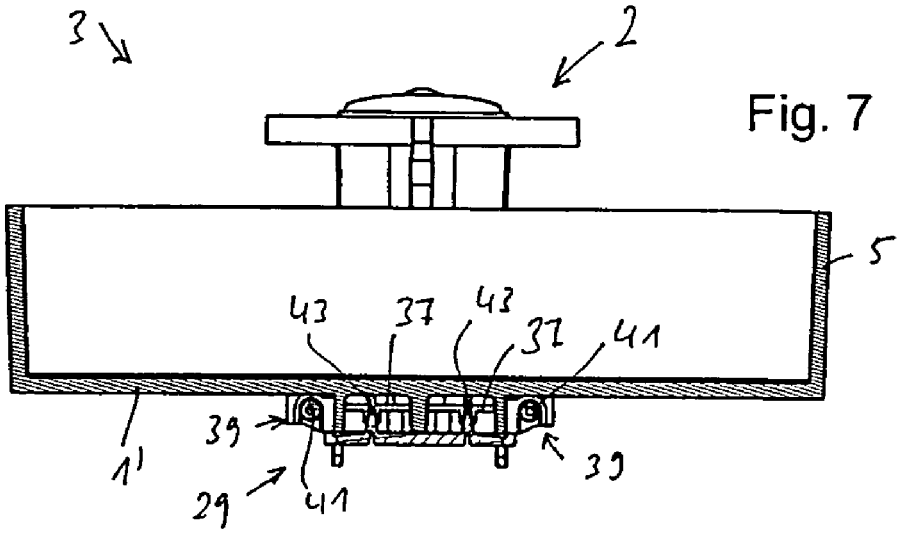
FIG. 7 shows a cross-sectional illustration through the reflector in the area of the functional part which is shown in FIG. 6 and is provided on the rear face of the reflector.

The following text refers to FIGS. 6 and 7.

FIGS. 6 and 7 will be used, by way of example only, to describe how further functional parts 29 can be integrated on the reflector in the course of the production method, which has been mentioned, for the reflector modules, preferably on their lower face (but if necessary or desirable, also on the upper face to which the antenna elements are fitted).

FIGS. 6 and 7 show outer conductor sections of a connecting and feed structure on the lower face for two antenna elements which are located vertically adjacent. The outer conductor contour which projects downwards from the plane 1' of the reflector 1 and is in the form of a circumferential housing web 35 is in this case used as an outer conductor. Inner conductors 43, for example, can then be anchored therein via holding devices 37, which can be inserted between these housing webs 35, are preferably nonconductive and are made of plastic. Coaxial cables 41 for example, can then be connected via feed points 39 that are likewise provided, by, for example, making electrically conductive contact between the outer conductor of the coaxial cable and the circumferential housing web 35, which carries out the outer conductor function while, on the other hand and electrically isolated from this the inner conductor of the coaxial cable is electrically conductively connected at some suitable point to the inner conductor 43 which is provided in the interior of the distributor formed in this way. The inner conductor is then passed so far in this connecting structure and is passed via one of the holes that are provided in the reflector plate to the other reflector plane, in order to produce an electrically conductive connection there for the antenna elements that are provided there.

However, other functional parts may likewise also be provided in the exemplary illustrative non-limiting reflector. For example, outer conductor structures and outer conductor contours for cables for radio-frequency signals, for example in the form of grooved cables, coaxial cables or striplines, may be formed. Also, for example, contours for electromagnetic screens, housing parts for RF components such as filters, diplexers, distributors, phase shifters can be formed or provided. For example, interfaces for holders, attachments, accessories etc can be provided.

The exemplary illustrative non-limiting implementations which have been explained have been used to describe how two identical antenna element modules can be joined firmly together by in each case one end wall 7. The opposite end faces are in this case of different designs, so that they can be joined together according to the exemplary illustrative non-limiting arrangements shown in FIGS. 3 to 4 on only one end face 7. For this purpose, the identically shaped reflector modules 3 are aligned rotated through 180° relative to one another in order to join them together. However, differently shaped antenna element modules can also be joined together in the vertical direction if they are each designed appropriately on at least one end wall, in order to make it possible to fix them firmly to one another there via a suitable holding and attachment device 27. More than two reflector modules, for example three or four etc., can also be joined together in the vertical direction or else in the horizontal direction at the sides to form an entire antenna array. If two or more reflector modules are joined together vertically, all that is then necessary is for at least the reflector modules which are arranged in the central area to be configured both on their upper and on their lower end wall regions 7 such that they can be joined to a next reflector module which is located adjacent.

The special feature of the functional parts which are to be mentioned is thus that a part of an additional functional part, for example the outer boundary which is used as an outer conductor is part of the reflector arrangement for a connecting device or for a phase shifter right from the start, so that these components just need to have further functional components or other components added to them to achieve a complete assembly.

Figure 8:
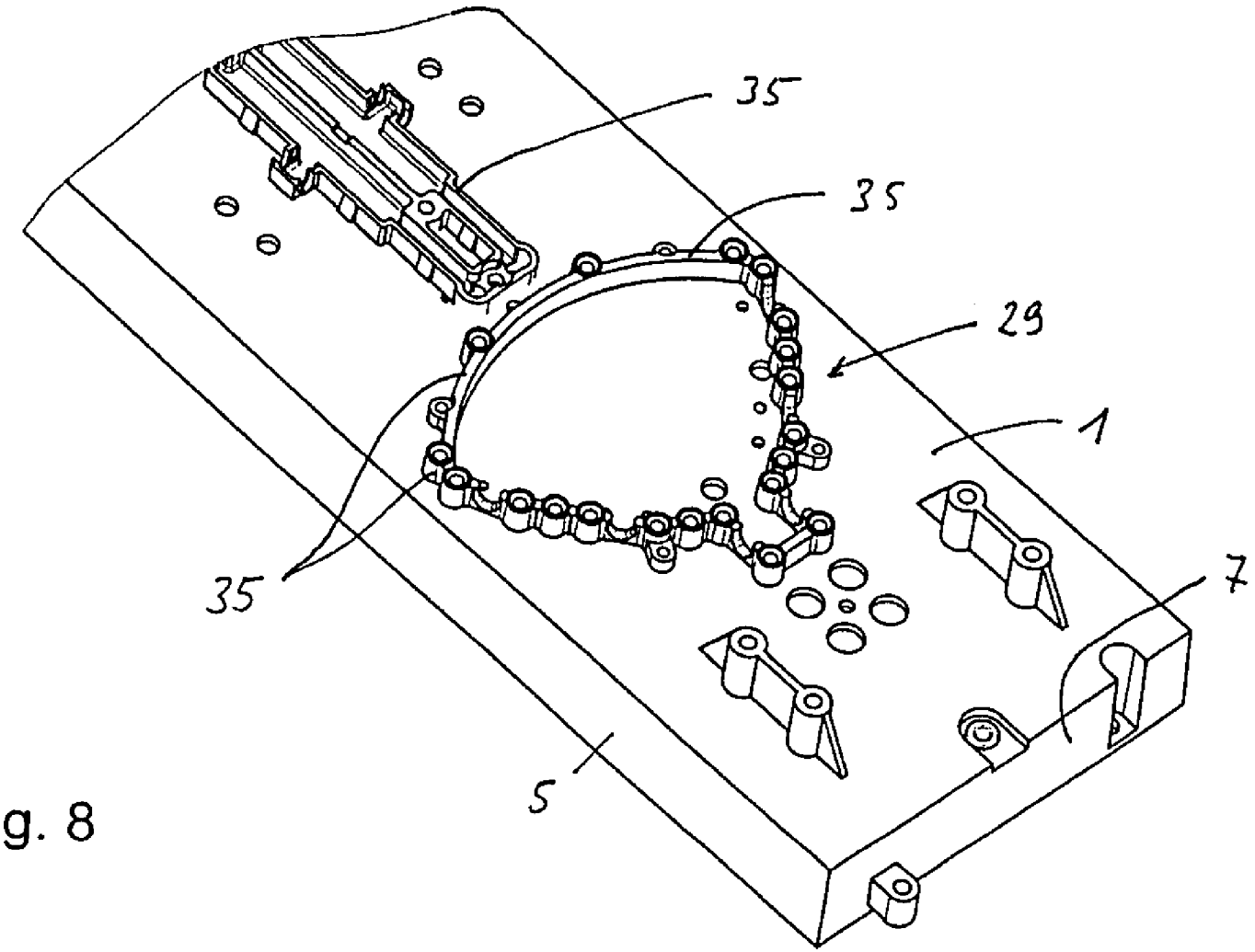
FIG. 8 shows a further perspective detail of a rearward view of an exemplary illustrative non-limiting reflector module with a differently shaped functional part.

The following text also refers to FIG. 8, which illustrates a further example for a different functional part. An outer boundary, that is to say a circumferential housing web 35 is shown here, connected to the reflector material and on the same level. The reflector itself in this case forms the bottom, while the housing web 35 forms the outer boundary. This functional part 29 may be used, for example, as a phase shifter arrangement which is provided on the rear face of the reflector. The phase shifters may in this case be constructed in the manner which is known in principle from the prior publication WO 01/13459 A1. To this extent, reference is made to this prior publication, whose contents are included in the present application. Thus, one or more concentrically arranged stripline sections, which are in the form of partial circles, can be accommodated in the corresponding configuration shown in FIG. 8 and interact with a pointer-like adjustment element, via which the path length to the two connected antenna elements or antenna element groups, and hence the phase angle for the antenna element, can be adjusted and set in order, for example, to make it possible to set a different down tilt angle. Any other desired different types of functional parts with other functions and tasks may be formed at least partially, in precisely the same way in the factory, on the reflector, preferably on its rear face. Once the further elements that are to be installed (but which are not shown in the drawings) for the functional part have been installed appropriately, the installation space which is formed by the reflector base and the circumferential housing web 35 can be closed by attaching and fitting a cover arrangement which, depending on the application, is electrically conductive, preferably formed from a metal part, or can otherwise also be formed from a plastic or dielectric part or the like.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. A reflector for an antenna, in particular for a mobile radio antenna, having two longitudinal face boundaries which are provided on the longitudinal faces of the reflector, comprising:

at least two reflector modules which are assembled, the reflector module is produced using a casting method, deep-drawing, thermoforming or stamping method, or using a milling method with the two integrally connected longitudinal face boundaries and at least one end transverse-face boundary, preferably two transverse-face boundaries whose ends are located offset with respect to one another, and preferably at least one transverse strut which runs transversely with respect to the longitudinal face boundaries, and a holding and/or attachment device is provided on the at least one end transverse-face boundary for attachment to a second reflector module, and can be used to fix the at least two reflector modules firmly to one another, each module comprises:

at least two radiating elements, an electrically conductive joint reflector on which at least two radiating elements are position, and the radiating elements on one joint reflector are dual polarized radiating elements.

2. The reflector according to claim 1, wherein the reflector module comprises a die-cast part, in particular a metal cast part, preferably an aluminum cast part and/or a metal part produced using the tixo casting method.

3. The reflector according to claim 1, wherein the reflector module comprises a die-cast or injection-molded part, preferably a plastic injection-molded part with a metalized surface.

4. The reflector according to claim 1, wherein the reflector has at least two identical reflector modules.

5. The reflector according to claim 1, wherein the reflector has at least two different reflector modules.

6. The reflector according to claim 1, wherein at least one reflector module can be joined to an adjacent reflector module, or are fixed to one another there, on its first end-face transverse face boundary or on its opposite second end-face transverse face boundary.

7. The reflector according to claim 1, wherein the at least two reflector modules of a reflector are designed on their end transverse face boundaries such that they can be fixed to one another or are mounted on one another in only one fitting direction.

8. The reflector according to claim 1, wherein the at least two reflector modules are conductively electrically connected to one another, preferably on their two end-face transverse face boundaries on which they are mounted on one another.

9. The reflector according to claim 1, wherein the at least two reflector modules of a reflector are fixed to one another such that the two end-face transverse face boundaries which are adjacent to one another of two reflector modules which are arranged such that they are adjacent are electrically conductively connected to one another.

10. The reflector according to claim 9, wherein an insulating intermediate layer or device, preferably a plastic layer and/or a dielectric, is inserted between the two end-face transverse face boundaries on which two adjacent reflector modules are fixed to one another.

11. The reflector according to claim 1, wherein at least two reflector modules of a reflector have a damping material or a damping layer between their two end-face transverse face boundaries.

12. The reflector according to claim 1, wherein the at least two reflector modules of a reflector have attachment points and/or attachments in the area of their end-face transverse face boundaries in order to produce mutual fixing and stabilization, which are provided or formed on different planes parallel to the reflector plane.

13. The reflector according to claim 1, wherein an attachment which is offset outwards towards a longitudinal face boundary from a central longitudinal plane which runs through the reflector module projects in the fitting direction on at least one end-face transverse face boundary, and in that an attachment which points inwards is provided more closely on the other side of the central longitudinal plane, and hence of the opposite longitudinal face boundary, with the attachment which projects outwards and the attachment which extends inwards being arranged at two different height levels, such that, when two reflector modules are joined together, the respectively formed attachments are rotated through 180° with respect to one another and can be connected to one another via attachment means, which run transversely with respect to the plane of the reflector, preferably in the form of screws.

14. The reflector according to claim 1, wherein nonconductive and/or dielectric holding attachment devices can be anchored, preferably fitted, or can be snapped etc., to the transverse struts, and functional parts which are used for beam forming and/or for decoupling can be inserted on said holding attachment devices, without making electrical contact with the reflector.

15. The reflector according to claim 14, wherein the functional parts are formed from metalized strips or metal strips, metalized pins or metal pins.

16. The reflector according to claim 1, wherein at least one holding and/or attachment device which is preferably in the form of a reinforcing section is provided in at least one transverse strut and/or at least one transverse face boundary and/or longitudinal face boundary, and a hole which preferably runs transversely with respect to the plane of the reflector module is formed by further functional parts in this holding and/or attachment device.

17. The reflector according to claim 1, wherein at least one additional integrated functional part is provided on the reflector module, preferably in the form of outer conductor contours and/or housing contours for cables for RF signals, grooved cables, coaxial cables or striplines, or contours for electromagnetic screens or housing parts for RF components such as filters, diplexers, distributors, phase shifters and the like.

18. The reflector according to claim 17, wherein the at least one further functional part which is provided is arranged on that face of the reflector module which faces to the rear with respect to the radiating elements.

19. The reflector according to claim 17, wherein the at least one functional part is provided on the front face of the reflector module, facing the radiating elements.

* * * * *